United States Patent [19]

Platt

[11] Patent Number: 4,864,791

[45] Date of Patent: Sep. 12, 1989

[54] FIRE STRIP

[75] Inventor: William J. Platt, Collingdate, Pa.

[73] Assignee: National Rolling Mills, Inc., Malvern, Pa.

[21] Appl. No.: 269,921

[22] Filed: Nov. 10, 1988

[51] Int. Cl.[4] ..... E04B 5/52

[52] U.S. Cl. ..... 52/317; 52/488; 52/DIG. 5

[58] Field of Search ..... 52/317, 484, 488, 489, 52/664, 665, DIG. 5, 668

[56] References Cited

U.S. PATENT DOCUMENTS 2,099,961 11/1937 McLaughlin et al. ..... 52/317 X
3,333,378 8/1967 Jahn et al. ..... 52/DIG. 5
3,473,282 10/1969 Robinson, Jr. ..... 52/488 X
4,594,832 6/1986 Akins ..... 52/488 X
4,791,766 12/1988 Egri, II ..... 52/317

FOREIGN PATENT DOCUMENTS 1055220 5/1979 Canada ..... 52/DIG. 5

*Primary Examiner*—Richard E. Chilcot, Jr.
*Attorney, Agent, or Firm*—Eugene Chovanes

[57] ABSTRACT

A fire strip for use in a suspended metallic grid ceiling structure. The strip extends between grid members in the ceiling. During a fire, the strip helps keep the grid intact, and keeps the ceiling tile in place, whereby the ceiling continues to act as a fire barrier.

5 Claims, 2 Drawing Sheets

FIRE STRIP

BACKGROUND OF THE INVENTION

The Prior Art

Ceilings in commercial and industrial structures are often of the suspended ceiling type wherein a metallic grid is suspended from the structural ceiling by, for instance, hanging wire. The grid forms rectangular openings of generally 2'×4' size which support standard size 2'×4' acoustical panels. The main and cross members of the grid are formed of inverted T-shape metallic members having a web and flange. The flange forms a shelf around the inside of the grid opening to support the acoustical tile which is laid on the top of the shelf. The web of the grid member serves to keep the tile aligned in the grid opening. The grid members are suitably interconnected at their intersections.

PROBLEMS IN THE PRIOR ART

Problems occur in the prior art ceiling described above during a fire. The heat from the fire causes the grid members to expand and twist, so that they no longer support the tile. The tile drops out, leaving the space above the ceiling open to the fire, permitting the fire to spread.

Numerous prior art efforts have been made to keep the grid relatively intact and capable of continuing to support the tile during a fire, whereby the tile, which is generally fire-resistant, can act as a barrier to further spread of the fire into the space above the suspended ceiling. The suspended ceiling is generally damaged and must be replaced after a fire, even if the tile continues to be supported, but it is the barrier effect during a fire which the prior art has sought to achieve in a fire-rated suspended grid ceiling.

The general approach to keeping the ceiling relatively intact during a fire involves means for permitting expansion of the metal grid members. Expansion means are sometimes provided at the member intersections by various forms of overlapping expansion joints. These involve often complicated configurations.

By permitting the grid members to expand longitudinally, the tendency of the members to buckle and twist is reduced, so that the tiles are more likely to stay in place.

Sometimes expansion means are provided along the lengths of the members, such as by pre-formed bend points which permit the cross or main grid members, which are in effect beams, to bend in a certain way to accommodate the expansion, while keeping most of the grid members relatively straight and intact, whereby it continues to support the tile.

At best, however, even with expansion means, the tiles sometimes fall out during a fire.

It is also noted that expansion means often weaken the installed grid during normal conditions, since the grid members are generally perforated to provide these expansion means.

SUMMARY OF THE PRESENT INVENTION

The present invention is concerned with an improvement to prior metallic ceiling grid structures for supporting acoustical tile. Such prior art grids have metal main and cross members formed of inverted T-shape cross sections. The grid openings are generally 2'×4' openings. A standard 2'×4' acoustical tile panel is supported within the grid opening on the flanges of the T-shape.

Such a prior art ceiling is made more fire-resistant by attaching the flat metallic strip of the invention to opposing cross members in the center of the grid opening to provide what appears to be 2'×2' grids when viewed from below.

During a fire, the strip keeps the panel in place in the ceiling since the grid opening through which the panel can fall is reduced. The strip also supports the panel, and resists the buckling and twisting of the T-shape grid members.

When viewed from below, the strip appears to be one of the grid members, so that the same general ceiling appearance is maintained. For instance, where the ceiling is composed of 2'×4' acoustical tiles, the ceiling appears to be composed of 2'×2' tiles when the fire strip of the invention is used.

Generally, the flange "shelf" supporting the standard 2'×4' acoustical tile is about ½" wide, so there is very little area of support for the tile to begin with; namely, a ½" shelf around a panel which measures nominally 24"×48". Since even with the prior art expansion means described above, it is virtually impossible to prevent some buckling and twisting, particularly in the cross beams (the 48" length, or the long side of the grid opening). Since the tile is being supported by a ½" edge "shelf", even a minor amount of buckling and twisting opens up the grid, permitting the tile to drop.

The present invention prevents the tile from dropping during a fire by (1) strengthening the grid against uncontrolled buckling and twisting, (2) substantially reducing the grid opening through which the tile ca fall to an area well below the tile size so that the tile is virtually prevented from falling through the grid opening, (3) forming secondary rectangular openings within the primary grid openings formed of the structural T-shape main members and cross members, (4) keeping the individual secondary grid opening relatively rectangular in shape even when the structural T-members buckle and twist; and (5) providing substantial additional shelf support for the tile panel.

The present invention consists of a flat strip, or strap, of metal, suitably conforming in appearance and shape to the flange of the T-shape ceiling structural grid member when viewed from below the ceiling, which is inserted between the main members forming the grid opening. The strip extends parallel to the main members and perpendicular to the cross members.

The strip desirably bisects a typical 2'×4' grid opening into two 2'×2' grid openings. A 2'×4' tile panel rests, as in the prior art, on the perimeter shelf formed by the flanges of the grid members, and also on the strip itself which is suitably secured to the cross members.

Although the present invention is illustrated with beams having flat underfaces on the flanges of the T-shape cross sections, it should be understood that the strip of the invention works equally well with other shapes on the underface of the flange. Such shapes are well known and in cross section constitute for instance slots, tier drops, box sections, and a bolt slot pattern. In such instances, the underface of the strip conforms to the underface of the beam flange. The top of the strip, however, continues to be flat as hereafter illustrated.

The strip of the invention can be used with prior art ceilings that have expansion means and are fire-rated as well as with normal non-fire rated ceilings known as Class A ceilings, as classified in the construction trade. The benefits of the invention are obtained with all types of ceilings.

In a fire, the strips acts, among other things, as a tension member which serves to keep the cross members from buckling, one away from the other The strip also resists twisting of the beams during a fire. The strip also serves to support the tile panel during a fire, at the panel's general mid-section. The strip also continues to form one side of a grid opening that is substantially less than the normal size, making it virtually impossible for the relatively large panel to drop out of the relatively small grid opening.

The invention permits the relatively large panel, for instance a 2'×4' panel, to be inserted in a conventional prior art suspended grid ceiling in a conventional manner through a 2'×4' grid opening (reduced by the flange "shelf" around the grip opening perimeter), after which the fire strip of the invention is secured, wherein all the benefits set forth above are secured.

BRIEF DESCRIPTION OF THE DRAWINGS

FIG. 3*a* shows a vertical slot at one end of the strip and opposing tabs at the other end of the strip.

FIG. 3*b* shows a strip having holes at the ends thereof to receive self-tapping screws.

FIG. 3*c* shows a strip having opposed bends at the opposite ends for insertion through a slot in the grid members.

DETAILED DESCRIPTION OF THE DRAWINGS

Figure 1:
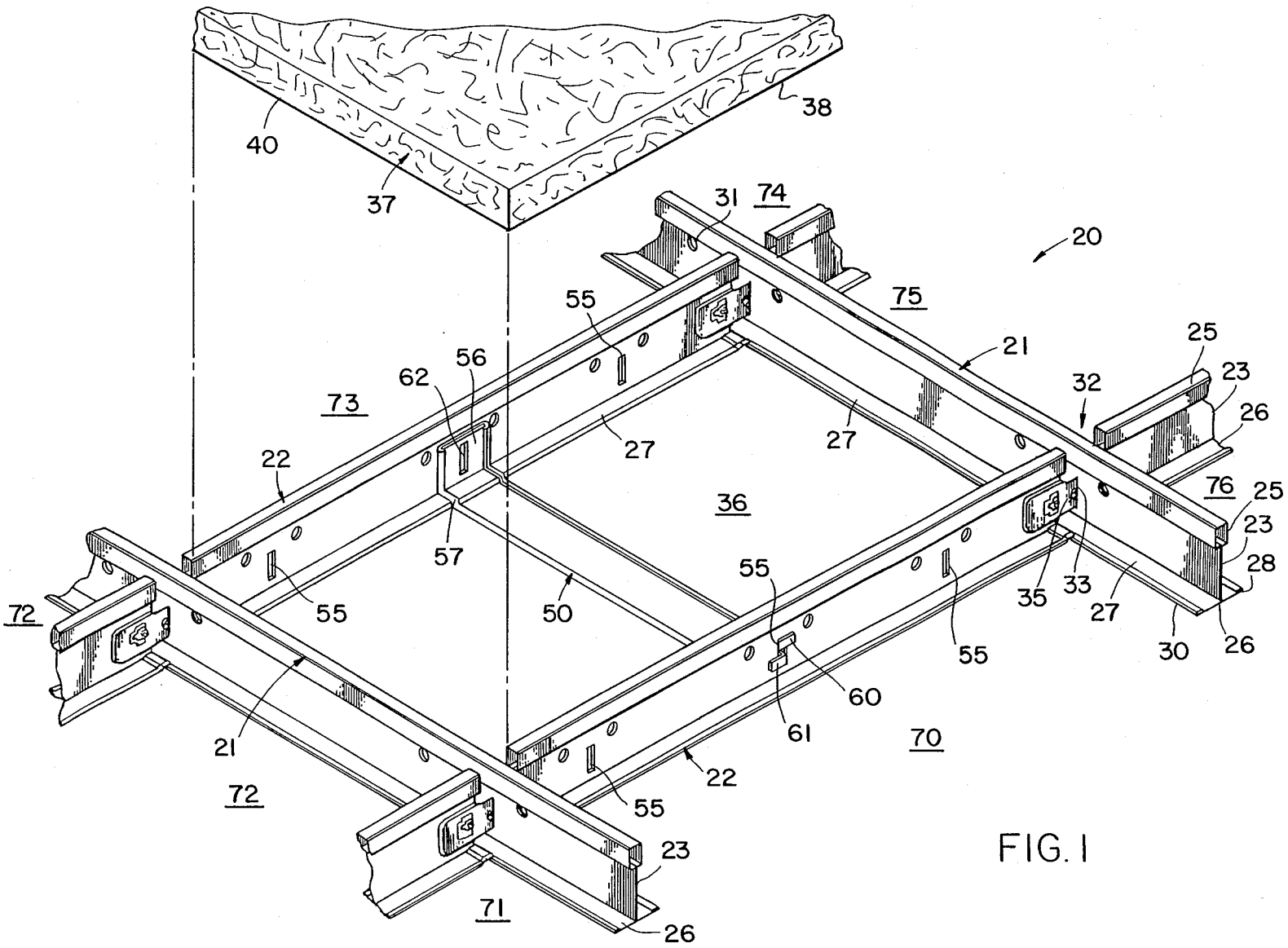
FIG. 1 is a perspective exploded view of a section of a suspended ceiling showing the strip of the invention in place.

There is shown in FIG. 1 a perspective view of a suspended ceiling 20 having main members 21 and cross members 22. The main members 21 and cross members 22 are T-shaped in cross section and have a web 23, a bulb 25 at the top thereof and a flange section 26 having opposed flanges 27 and 28. The flanges have suitable beads 30 along the edges thereof.

Both the main members 21 and cross members 22 are shown having the same cross-sectional shapes. The main members 21 extend longitudinally of the ceiling and are suspended from the structural ceiling through wires (not shown) which engage suspension holes 31 in the well known prior art manner. Main members 21 extend parallel to one another at a distance generally on 4' centers, and have extending therebetween cross members 22 which suitably interlock to the main members at interlock 32. Such interlocks are of various types and are well known in the prior art. In the interlock shown, a slot 33 receives tongue 35 at the end of cross members 22. The tongues 35 from the opposing cross members on either side of the main grid member 21 extend adjacent one another through the slot and have suitable detents or the like which keep the beams interlocked.

In ceiling grids of a fire-rated type, various different interlocks or joints 32 provide expansion means whereby under the heat of a fire, the cross members expand longitudinally through the main beam, wherein the abutting tongues overlap one another and slide with respect to one another, permitting expansion and reducing the buckling and twisting effect which occurs during a fire. The twisting and bending effect on the cross member occurs when free expansion of the member longitudinally during a fire is blocked, as it virtually always is, because of the grid interconnections.

Normally, the cross members 22 which extend parallel to one another are spaced on 2' centers, and the main members are spaced on 4' centers. This results in a 2'×4' grid opening 36, rectangular in horizontal area, having a flange 27 extending around the entire interior perimeter of the grid opening 36, forming a shelf 29. The flange is on the order of ½" in width. An acoustical tile 37 of a 2'×4' dimension corresponding to the grid opening 36 formed between webs 23 of members 21 and 22 is inserted in assembling the ceiling through grid opening 36 at an angle and then leveled into a horizontal position and laid upon flanges 27 that extend around the interior perimeter of grid opening 36. The acoustical tile is of the well known prior art type of for instance ½" in thickness of a composite fiberboard and has long sides 38 and short sides 40 which form a rectangle of a 2'×4' dimension in the assembly being described. The 2'×4' panel is laid on the shelf and the sides 38 abut webs 23 of cross members 22. Sides 40 of tile 37 abut webs 23 of main members 21.

The above description is by way of illustration only and is illustrative of the well known prior art structures.

The device of the invention involves a fire strip 50 which extends between cross members 22. The strip 50 has at both of its ends fastening means 51 for so securing the strip to member 22. The strip 50 has a body portion 52 which desirably conforms in thickness to flange portion 26 of the grid members 21 and 22 so that the strip conforms in appearance when viewed from below the ceiling to the members 21 and 22. Bead 53 conforming to bead 30 of the grid members extends along the edges of the strip.

In FIG. 1, there is shown slots 55 spaced periodically along the cross members. Selected slots 55 receive fastening members 51 of strip 50. The strip conforms in length to the exact distance between the webs 23 of opposing cross members 22. In the assembly being illustrated, this distance would be 2' in length.

Figure 2:
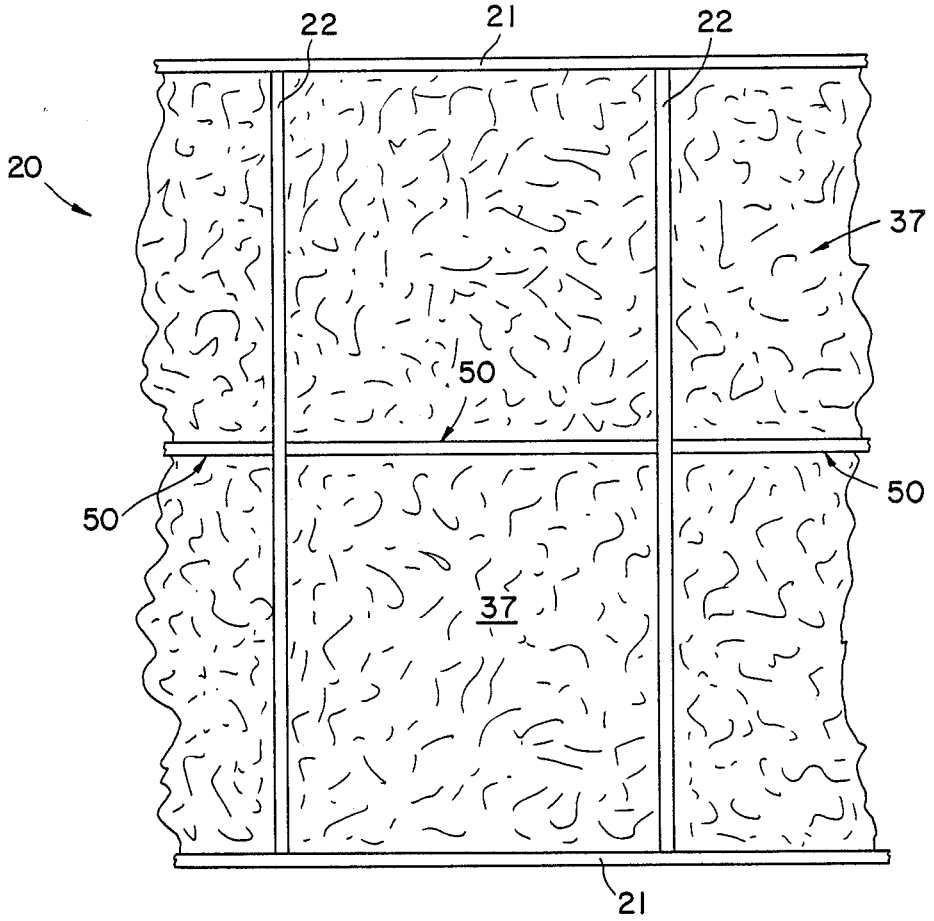
FIG. 2 is a bottom plan view of a section of a suspended ceiling showing the strip of the invention.

Fastening elements 51 have angle portion 56 extending upward from body portion of the strip 50. The strip has a suitable offset 57 at each end. Offset 57 conforms to the thickness of the flange 27 on cross member 22. The offset 57 extends in length the width of flange 27, for instance ½". When inserted between cross members 22 and viewed from below, the lower face of web portion 52 of strip 50 extends in the same plane as the lower face of cross members 22 and main members 21. When viewed from below as seen in FIG. 2, strip 50 is indistinguishable from main members 21 and cross members 22 and would appear to be one of such members having a T-shape cross section wherein 2'×2' tiles are being used. Such appearance is illusory only, since 2'×4' tiles are being used in 2'×4' grid openings with fire strip 50 inserted midway between opposing main members 21.

Figure 3A:
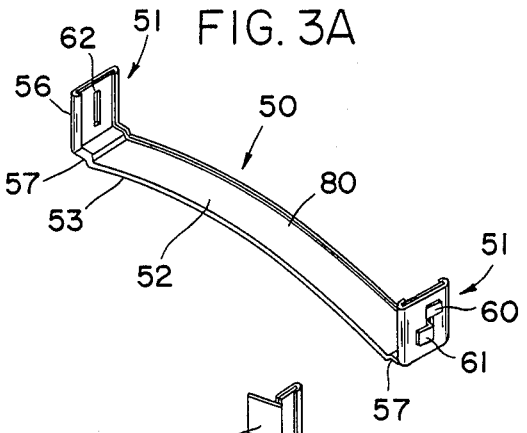
FIGS. 3*a*, 3*b* and 3*c* are perspective views of the various embodiments of the strip of the invention.
Figure 3B:
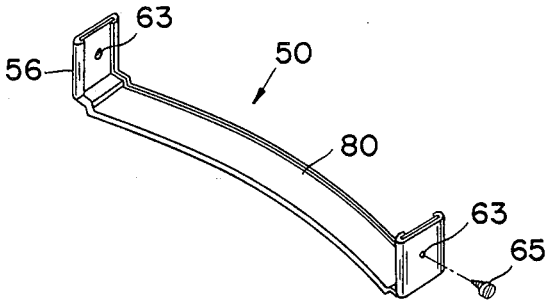
Figure 3C:
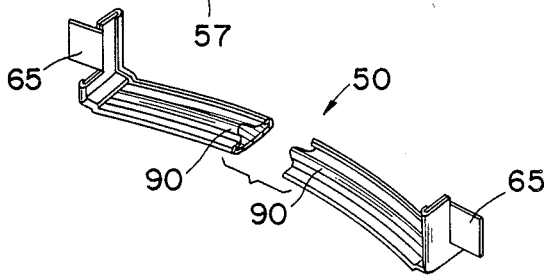

In FIG. 1, opposing tabs 60 and 61 have been bent in opposing directions after being inserted through the slot with the tabs extending longitudinally of the strip as seen for instance in a single tab 61 in FIG. 3*c*.

Fastening member 51 can also take the form of simply a slot in angle 56. A slot 62 as seen in FIG. 1 and FIG. 3*a* is aligned with slot 55 in cross member 22 after which a separate fastening clip or pin can be inserted through the matching slots and then bent or otherwise secured.

The intent of fastening means 56 is to securely fix end of fire strip 50 to cross beam 22. Alternative forms of fastening means 51 are shown in FIGS. 3*a* through 3*c*. In 3*b*, angle 56 has hole 62 which receives a self-tapping screw 65 which passes through a connecting slot 55 in cross member 22. In FIG. 3*c*, there is shown a single tab 63 which extends through slot 55 on cross member 22. It should be understood that the various illustrative fastening means shown are merely illustrative and that any suitable fastener in the form of a clip, tab, screw, detent, nut and bolt, or the like can be used.

It is intended that the fire strip be inserted into the ceiling grid as shown after the acoustical tile 37 has been inserted through grid opening 36 and temporarily suspended above the grid opening while the strip is attached.

In the alternative, the strip can be inserted into one grid opening and the panel brought into place through adjacent grid opening 36 which has not yet received its fire strip. The panel is simply spaced over the main or cross member or members and laid in place within the confines of webs 23 on opposing cross members 22 and opposing main members 21 on top of the flanges 27 and fire strip 50.

It should be understood that the strips are placed in continuing longitudinal alignment with one another as seen for instance in FIG. 2. Only one strip is shown in a grid opening 36, for purposes of clarity, but in an actual ceiling, it is intended that strips also be placed in adjacent grid openings 70 through 76.

It is desirable that fastening means 51 be such that they can be inserted from each side of the same slot 55 in cross member 22, and fastened thereto.

The body 52 of fire strip 50 is desirably preformed to have a bowed or arched configuration 80 wherein the body or arch is curved upwardly in a spring-like effect. When the tile 37 is inserted, the body or arch 80 is forced downwardly into a horizontal plane wherein strip 50 snugly fits against the panel. It should be understood the body or spring effect is a very slight one, and not to a degree that would lift the tile 37 from a resting posture on flanges 27. The body or spring effect is simply to keep the strip from any sagging or spacing from the tile 37 itself, and eliminates any need for an exact, precise length of fire strip 50 wherein any tendency to sag would be eliminated by exerting tension on the ends of the strip. The arch or body 80 is desirable but not necessary in practicing the invention.

During a fire, the grid members 21 and 22 expand from the effects of the heat. Joints 32 may or may not absorb some of this expansion. Fire strip 50 keeps opposing members 22 at its end, from buckling in directions non-parallel to one another, thus maintaining the integrity of the 2′×2′ grid opening formed by the strip. The buckling which does occur is in generally parallel relationship in both opposing members 22. Additionally, strip 50 with its fastening means 51 can keep members 22 from twisting, whereby flange 27 rotates, thus providing a larger opening and thus allowing tile 37 to follow. Additionally, strip 50 simply locks the large tile from falling through, since it extends midway along the 4′ dimension of opening 36, in effect creating a 2′×2′ grid opening through one 2′×4′ grid.

In an alternative embodiment of the invention, the body 52 of fire strip 50 may have running longitudinally along its top side a reinforcing ridge or bead 90 as seen broken away in FIG. 3c. Such bead or ridge 90 serves to stiffen the strip to prevent sagging. The tile panel if necessary may be correspondingly notched or scored along a line which corresponds to ridge or bead 90, to avoid any interference It should be understood, however, that if the panel is so scored or notched, the length of such notch is not such that would weaken the panel structurally. For instance, in a panel having a thickness of $\frac{5}{8}''$, the depth of the notch would not exceed $\frac{1}{4}''$. The intent of the invention is to keep the panel in one piece, and to use the fire strip as explained above, to support the panel in the manner described.

It is understood of course that any fire-rated ceiling including one using the device of the invention will suffer damaging effects during a fire, and generally must be replaced since even with the device of the invention, there is of course substantial structural damage in the form of breaks, twists, buckling and the like. The purpose of the invention, as is the purpose generally of a fire-rated suspended ceiling, however, is not to prevent the ceiling from being damaged during a fire, but rather to keep the ceiling structurally intact including keeping the tiles in place during a fire so that the ceiling continuously acts as a barrier to the further spread of such fire.

I claim:

1. In a suspended grid for an acoustical tile ceiling, (1) main grid members, and (2) cross grid members extending transversely to the main members that intersect and interconnect to form a ceiling grid having rectangular grid openings, the main and cross members being metallic and having inverted T-shaped cross sections having a top and a bottom; said grid members further comprising a bulb disposed at said top, a web and a flange portion disposed at the bottom, and the improvement comprising (3) a metallic strip in a grid opening extending (a) parallel to the main grid member and (b) between and secured to opposing cross grid members, the strip having (1) a body portion having an under side and an upper side and (2) connecting portions at each end of the body portion, and (3) said underside of the body portion conforming in size and appearance to the underside of the grid members flange portion, and said upper side of the body portion in cross section being substantially flat, wherein, in a grid opening, a tile can be supported on the upper side of the flange portions of the grid members, and the upper substantially flat side of the body portion of the metallic strip, the improvement comprising having the body portion of the strip in an upwardly curved, preformed, yieldable, spring-like arch (80) configuration, so that the strip can yield and fit snuggly against a tile when a tile is supported in a grid opening.

2. A ceiling of claim 1 wherein the grid members and metallic strip are substantially identical in appearance when viewed from below the ceiling when an acoustical tile is being supported by such grid members and metallic strip.

3. A ceiling of claim 1 wherein the grid members have slots in the web portions thereof to receive the connecting portions of the metallic strip.

4. A ceiling of claim 1, wherein the upper side of the body portion has a longitudinally extending reinforcing ridge.

5. A ceiling of claim 4, wherein the ceiling tile has a notch corresponding to the reinforcing ridge, whereby interference between the strip and panel is avoided.

* * * * *